US008151749B2

(12) United States Patent
Smith et al.

(10) Patent No.: US 8,151,749 B2
(45) Date of Patent: Apr. 10, 2012

(54) VALVE OPENING ARRANGEMENT AND METHOD

(75) Inventors: Edward Smith, McConnellsburg, PA (US); Chun Tai, Hagerstown, MD (US); Timothy Suder, Greencastle, PA (US)

(73) Assignee: Mack Trucks, Inc., Greensboro, NC (US)

( * ) Notice: Subject to any disclaimer, the term of this patent is extended or adjusted under 35 U.S.C. 154(b) by 367 days.

(21) Appl. No.: 12/516,387

(22) PCT Filed: Dec. 12, 2006

(86) PCT No.: PCT/US2006/061908

§ 371 (c)(1),
(2), (4) Date: May 27, 2009

(87) PCT Pub. No.: WO2008/073122

PCT Pub. Date: Jun. 19, 2008

(65) Prior Publication Data

US 2010/0071643 A1 Mar. 25, 2010

(51) Int. Cl.
*F01L 1/34* (2006.01)

(52) U.S. Cl. ..... 123/90.15; 123/90.12; 123/90.17; 123/90.39

(58) Field of Classification Search ..... 123/90.12, 123/90.13, 90.39, 90.15, 90.17
See application file for complete search history.

(56) References Cited

U.S. PATENT DOCUMENTS

| | | | | |
|---|---|---|---|---|
| 4,696,265 | A | 9/1987 | Nohira | |
| 4,793,307 | A | 12/1988 | Quennville et al. | |
| 5,193,497 | A | 3/1993 | Hakansson | |
| 5,609,133 | A | 3/1997 | Hakansson | |
| 5,829,397 | A * | 11/1998 | Vorih et al. | 123/90.12 |
| 5,937,807 | A | 8/1999 | Peters et al. | |
| 6,152,104 | A | 11/2000 | Vorih et al. | |
| 6,732,685 | B2 * | 5/2004 | Leman | 123/90.12 |
| 6,948,310 | B2 | 9/2005 | Roberts, Jr. et al. | |
| 2004/0060284 | A1 | 4/2004 | Roberts, Jr. et al. | |
| 2004/0112330 | A1 | 6/2004 | Hakansson et al. | |
| 2004/0237932 | A1 | 12/2004 | Persson | |
| 2006/0005796 | A1 | 1/2006 | Janak et al. | |

FOREIGN PATENT DOCUMENTS

| | | | |
|---|---|---|---|
| DE | 4440289 | A1 | 5/1996 |
| JP | 8510310 | | 10/1996 |
| WO | 9807965 | A1 | 2/1998 |
| WO | 0242612 | A1 | 5/2002 |

* cited by examiner

*Primary Examiner* — Ching Chang
(74) *Attorney, Agent, or Firm* — WRB-IP LLP

(57) ABSTRACT

An engine with a valve opening arrangement includes an engine including at least one cylinder and at least one valve for opening and closing an opening in the cylinder. The valve is spring loaded to a closed position. The engine also includes a movable contact surface for urging the valve to an open position, and a control arrangement at least partially connected to the contact surface and operable in a modified mode to at least one of advance opening and delay closing of the valve relative to opening and closing in a normal mode.

23 Claims, 7 Drawing Sheets

VALVE OPENING ARRANGEMENT AND METHOD

BACKGROUND AND SUMMARY

The present invention relates, generally, to valve opening arrangements for valves in cylinders and, more particularly, to such arrangements including controls for adjusting opening and closing of the valves.

In diesel engines, it is often necessary to treat exhaust gases to meet emissions requirements. Some exhaust aftertreatment equipment must be at least periodically operated at high temperatures to function properly. At low engine speeds, it is typically necessary to provide an auxiliary burner in the post-turbine exhaust. Such a solution involves the use of additional fuel.

It is desirable to provide a method and equipment for adjusting exhaust gas temperature in an engine. It is also desirable to provide a method and equipment for adjusting valve opening and closing timings.

According to an aspect of the present invention, an engine with a valve opening arrangement comprises an engine comprising at least one cylinder and at least one valve for opening and closing an opening in the cylinder, the valve being spring loaded to a closed position, a movable contact surface for urging the valve to an open position, and a control arrangement at least partially connected to the contact surface and operable in a modified mode to at least one of advance opening and delay closing of the valve relative to opening and closing in a normal mode.

According to another aspect of the present invention, a method of modifying valve timing comprises, during a normal mode, moving a contact surface to apply a force to urge a spring-loaded valve to an open position, and thereafter releasing the force so the spring force moves the valve to a closed position and, during a modified mode, operating a control arrangement at least partially connected to the contact surface to at least one of advance opening and delay closing of the valve relative to opening and closing during the normal mode.

According to another aspect of the present invention, a device with a valve opening arrangement comprises at least one cylinder and at least one valve for opening and closing an opening in the cylinder, the valve being spring loaded to a closed position, a movable contact surface for urging the valve to an open position, and a control arrangement at least partially connected to the contact surface and operable in a modified mode to at least one of advance opening and delay closing of the valve relative to opening and closing in a normal mode.

BRIEF DESCRIPTION OF THE DRAWINGS

The features and advantages of the present invention are well understood by reading the following detailed description in conjunction with the drawings in which like numerals indicate similar elements and in which.

DETAILED DESCRIPTION

Figure 1:
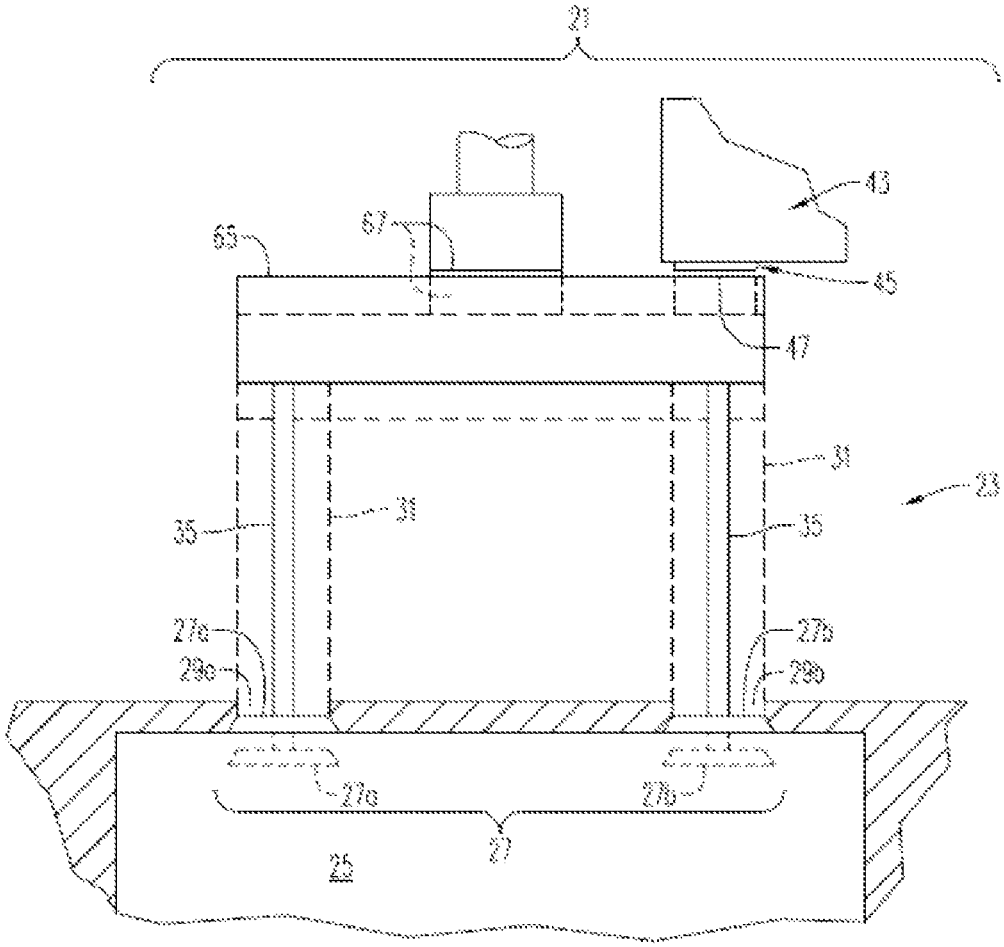
FIG. 1 is a schematic, partially cross-sectional view of a portion of a valve opening arrangement according to an embodiment of the present invention.

A portion of an engine 21 with a valve opening arrangement 23 according to an embodiment of the present invention is shown in FIG. 1. The engine 21 comprises at least one and, more commonly, a plurality of cylinders 25 and at least one valve 27, here shown as including two valves 27*a* and 27*b*, for opening and closing corresponding openings 29*a* and 29*b* in the cylinder. The valves 27*a* and 27*b* are exhaust valves. It will be appreciated that the valve opening arrangement according to the present invention is not limited to use in conjunction with an engine or exhaust valves but, rather, can be used in a variety of applications where it is necessary to open and close valves.

The valve or valves 27*a* and 27*b* can be loaded, such as by means of a spring 31 (shown in phantom in FIG. 1 around the valve stems 35), to a closed position. For convenience, the expression "spring loaded" in the present application will be understood to comprise all suitable structures for urging a valve to a closed position, and does not necessarily mean that a spring is used. Whether the valves 27*a* and 27*b* are urged open or closed by a spring or some other means is largely immaterial to the present invention.

Figure 2:
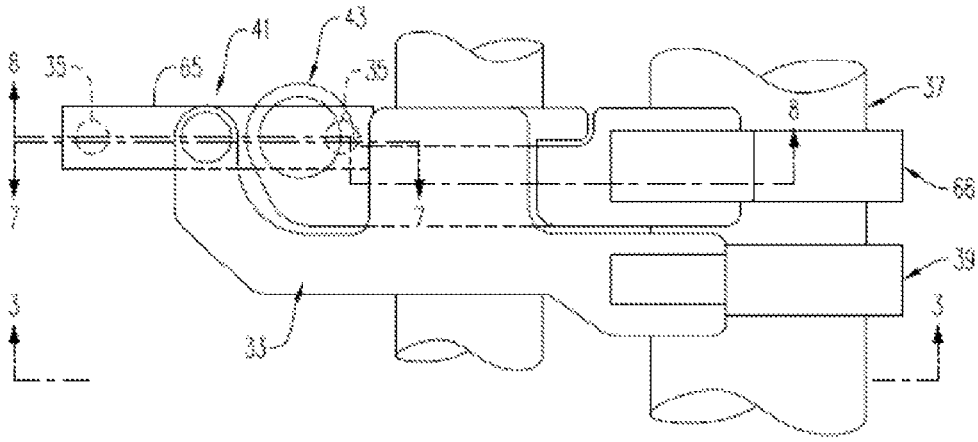
FIG. 2 is a top view of a portion of a valve opening arrangement according to an embodiment of the present invention.
Figure 3:
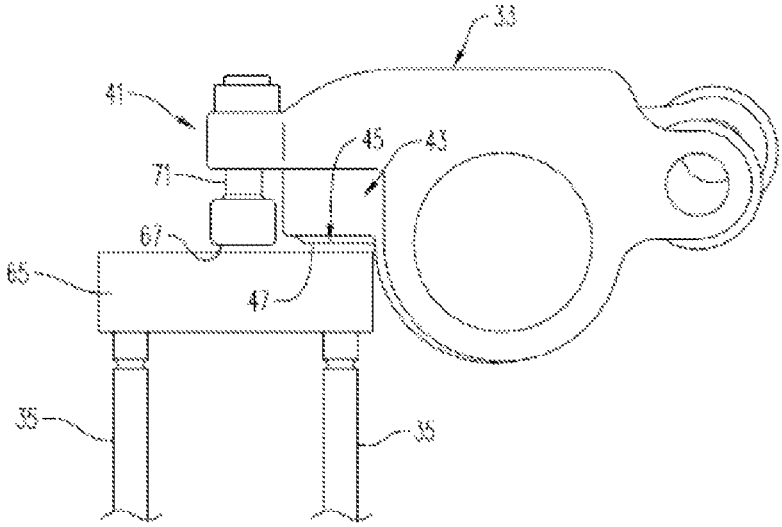
FIG. 3 is a side view taken at section 3-3 of the portion of the valve opening arrangement of FIG. 2.
Figure 4A:
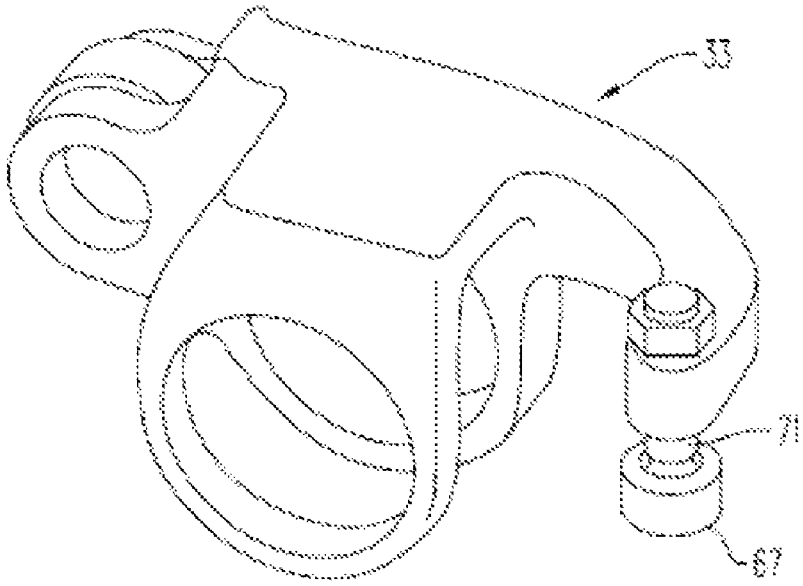
FIGS. 4A and 4B are top perspective views of a first and a second rocker arm, respectively, for use in connection with a valve opening arrangement of the type shown in FIG. 2.

In a normal mode of operation of the illustrated cylinder 25 exhaust valves 27*a* and 27*b*, the valves can be opened by pivoting action of a first rocker arm 33 (e.g., shown as part of an assembly in FIGS. 2 and 3, and shown by itself in FIG. 4A) which moves a contact surface 67 associated with the rocker arm to contact a stem 35 of the valve to urge the valve to an open position inside the cylinder 25 against the force of the spring, as shown in phantom in FIG. 1. The first rocker arm 33 is typically pivoted by means of a cam 39 on a cam shaft 37 acting on the rocker arm or a connecting rod connected to the rocker arm in a conventional manner, as seen in FIG. 2. As the cam shaft 37 turns so that a narrower portion of the cam 39 acts on the rocker arm 33, the force of the spring causes the rocker arm to pivot to follow the form of the cam and also urges the valves 27*a* and 27*b* to a closed position relative to the opening 29*a* and 29*b*. While, in an engine application, the contact surface 67 will ordinarily be associated with a rocker arm, it will be appreciated that, in other applications, the contact surface may be moved by some other means, such as by reciprocation of a piston.

Figure 5:
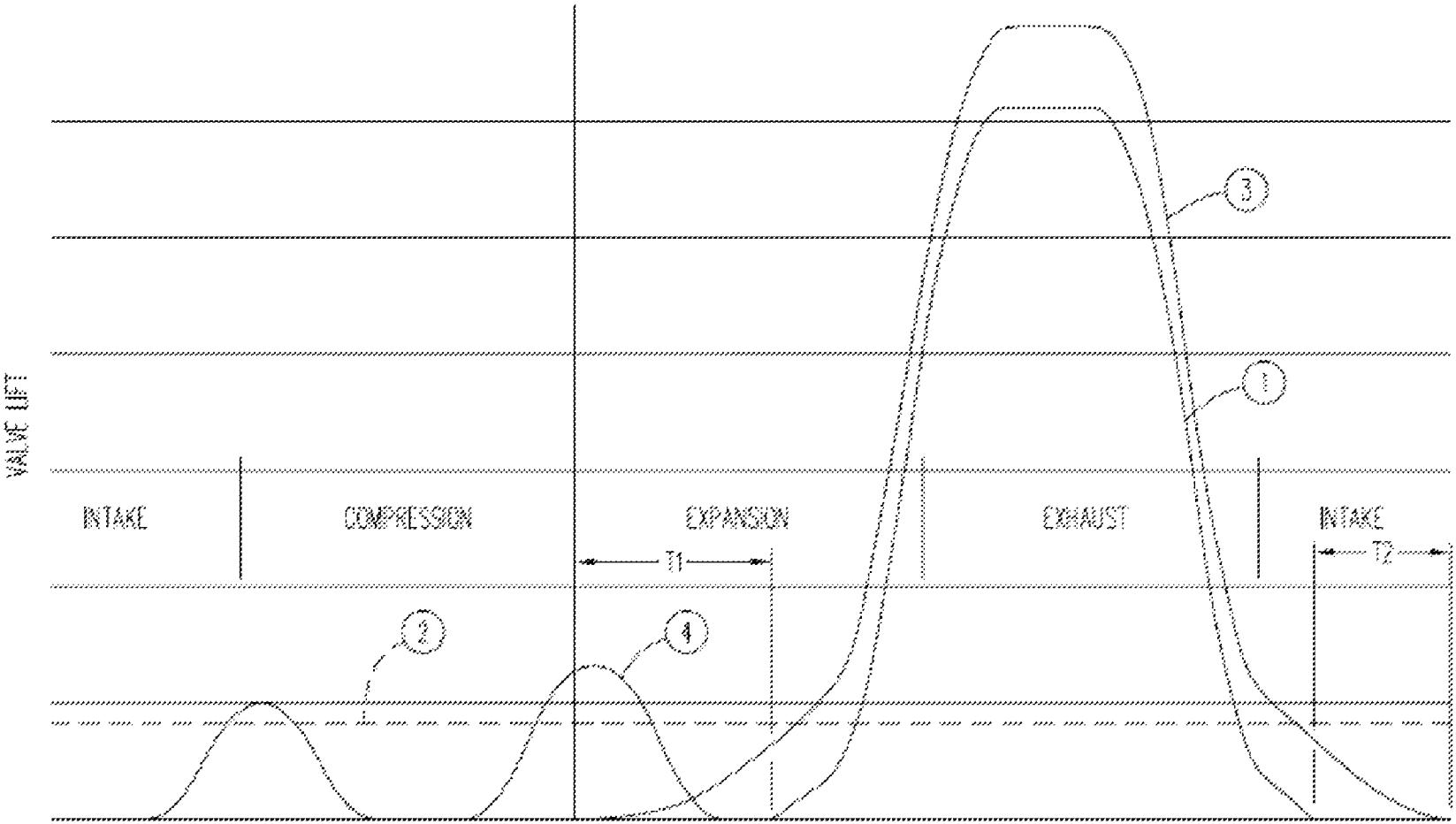
FIG. 5 is a graph of typical lift profiles of a valve over a range of positions of a cam shaft in a valve opening arrangement according to an embodiment of the present invention.

FIG. 5 illustrates graphically a typical lift profile "1" of a valve over a range of positions of the cam shaft 37 as the valve is raised and lowered by an arrangement such as described in connection with FIGS. 1 and 2. It will be appreciated that the lift profile can be longer or shorter, as desired, by, for example, adjusting the shape of the cam 39. The dotted line "2" illustrates the lash that can be present in the system during normal operation. Before the valves 27*a* and 27*b* lift from the openings 29*a* and 29*b*, the lash must be overcome.

The valve opening arrangement 23 also comprises a control arrangement 41 (FIG. 9) at least partially disposed on the first rocker arm 33 and adapted to alter opening and/or closing of the valves 27*a* and 27*b*, such as by advancing opening and/or delaying closing of the valves relative to opening and closing by the rocker aim. The control arrangement 41 may comprise a movable piston 71 that is movable in a cylinder 73 in the first rocker arm 33 as shown in, e.g., FIG. 9 to an active position to advance opening and delay closing of the valves 27*a* and 27*b* relative to opening and closing of the valves when the movable piston is in a retracted position. The contact surface 67 can be part of the piston 71. FIG. 5 illustrates graphically a typical lift profile "3" of the valves 27*a* and 27*b* lifted by the first rocker arm 33 with the piston 71 extended to largely reduce lash in the system. It will be observed that, in the lift profile "3", the opening of the valves is advanced a time T1 and the closing time of the valves is delayed a time T2 relative to the lift profile "1". T1 may be equal to T2, however, the opening and closing of the valves may be advanced and delayed different amounts, i.e., T1≠T2. Ordinarily, the sooner after fuel ignition and before substantial expansion has occurred that the exhaust valve opens, the greater will be the temperature of the exhaust gas.

Figure 4B:
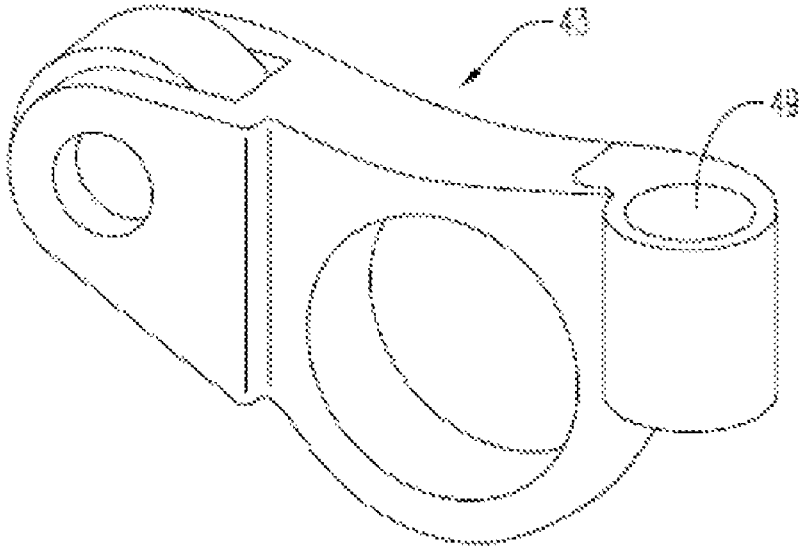

A second rocker arm 43 (shown by itself in FIG. 4B) can also be provided. While the second rocker arm 43 can be configured to advance opening and/or delay closing of the valve 27 in the manner of the first rocker arm 33 for purposes of adjusting exhaust temperature, it will ordinarily be used primarily to alter opening and closing of the valve 27 to control engine braking. The second rocker aim 43 can comprise a movable piston 45 with a head or contact surface 47 movable to an active position to alter opening and closing of the valve 27 relative to opening and closing by the rocker arm 33 during normal mode operation. FIG. 5 shows valve lift during normal mode operation, i.e., the first rocker arm 33 pivoting to move the valve, at line "1" and, at line "4", opening and closing of the valve 27 by the combined action of the pivoting of the second rocker arm 43 and the extension of the piston 45 of the second rocker arm 43.

The first and second rocker arms 33 and 43 can be pivoted by a common cam shaft 37 and cam 39 so they will pivot in unison. However, if it is desired that the second rocker arm 43 pivot at a different timing than the rocker arm 33, the second rocker arm may by pivoted by a separate cam 66 that can, for example, cause the second rocker arm to pivot before and/or after the first rocker arm, and/or with a different frequency. Line "4" in FIG. 5 shows the effects of the second rocker arm 43 pivoting at a different frequency and to a different extent than the first rocker arm 33.

Figure 6:
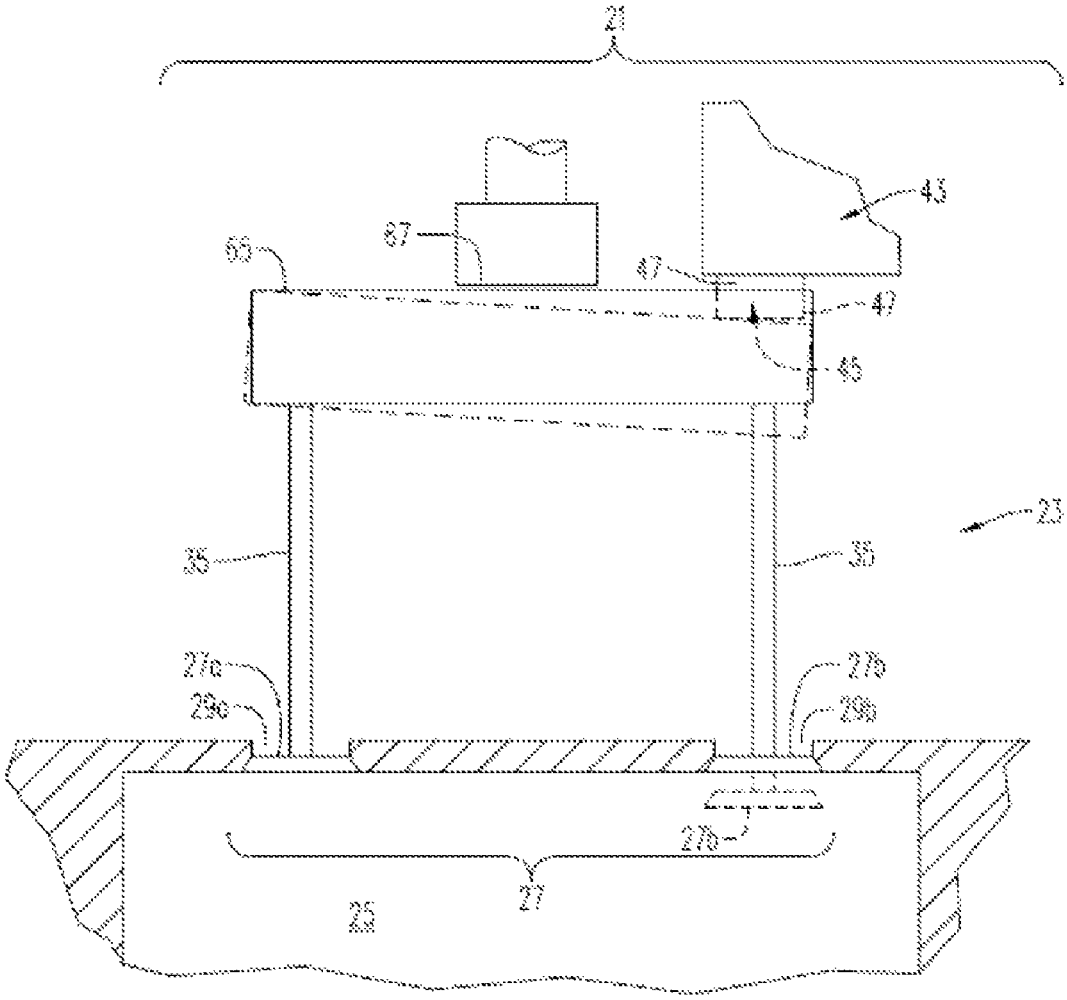
FIG. 6 is a schematic, partially cross-sectional view of a portion of a valve opening arrangement according to an embodiment of the present invention showing, in phantom, one of two valves opened.
Figure 7:
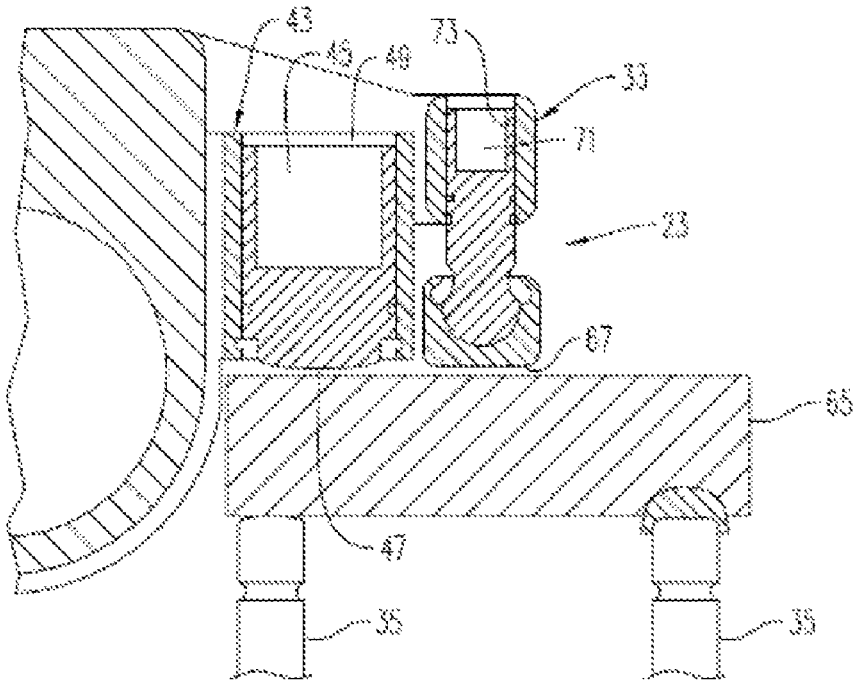
FIG. 7 is a side, partially cross-sectional view taken at section 7-7 of the portion of the valve opening arrangement of FIG. 2.
Figure 8:
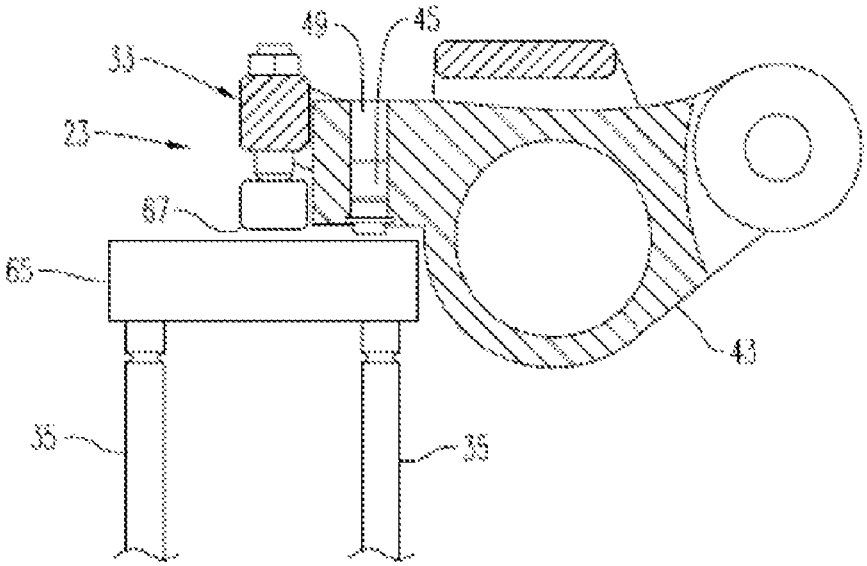
FIG. 8 is a side, partially cross-sectional view taken at section 8-8 of the portion of the valve opening arrangement of FIG. 2.

As shown in exaggerated fashion and in phantom in FIG. 6, the head 47 of the piston 45 can extend outwardly of a cylinder 49 (FIGS. 7 and 8) in the second rocker arm 43 to open the valve 27. In FIG. 6, when the piston 45 is in the active position, the valve 27*b* can be opened without opening the valve 27*a*, however, the piston and valves may be arranged so that both valves are opened by movement of the piston. The head 47 may be entirely or substantially retracted inside of the second rocker arm 43 when it is in an inactive position as seen in FIG. 7, or it may extend out of the second rocker arm, but to a lesser degree than when in an active position, as seen in FIG. 8.

Like the head 47 of the piston 45, the head or contact surface 67 of the piston 71 can be refracted inside of or extend out of the cylinder 73 during operation in the normal mode and extend out when it is desired to advance opening and/or delay closing of the valve 27*a* and 27*b*. In the illustrated embodiments, the head or "elephant's foot" 67 of the piston 71 extends outside of the cylinder 73. It will be appreciated that, as used herein, a "contact surface" that directly or indirectly contacts the valve stems 35 or the yoke 65 to move the valves 27*a* and/or 27*b* relative to the openings 29*a* and/or 29*b* can be, in some circumstances, a piston head 67 and/or 47 and, in other circumstances, can be part of a larger assembly, such as a surface of a rocker arm 33 and/or 43 in which a piston head can be retracted. A contact surface is not limited to being one or the other of a surface of a rocker arm or a surface of a piston in the rocker arm.

Figure 9:
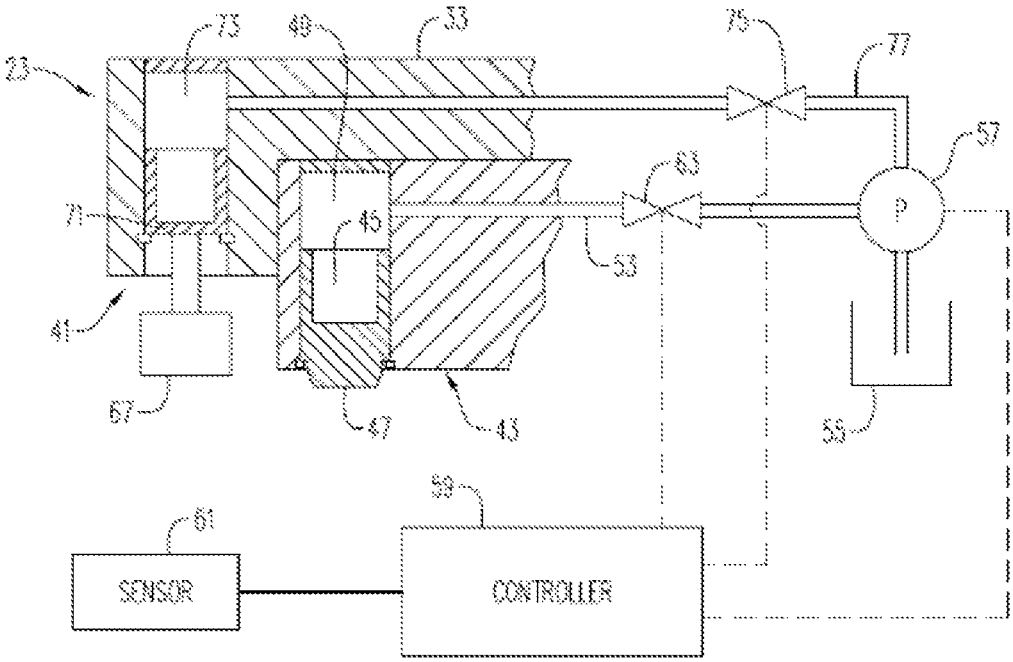
FIG. 9 is a schematic view of a valve opening arrangement according to an embodiment of the present invention.

As seen in FIG. 9, the pistons 71 and 45 can each be individually driven to an active position by hydraulic pressure in the cylinders 73 and 49 provided through lines 77 and 53 leading to a suitable source 55 of hydraulic fluid and a pump 57, however, they can be moved by any suitable means, such as by being moved mechanically, pneumatically, or via electrically operated or magnetic means. When hydraulic pressure is relieved or reduced, the piston 71 or 45 can be moved to an inactive or retracted position by any suitable means, such as by a spring, such as the spring loading the valve 27. For example, the spring force can be transmitted to the piston 71 or 45 directly or through, e.g., a yoke 65 (e.g., FIG. 1) to force the piston 71 or 45 from one active position to another, or to a retracted position. U.S. Pat. No. 5,193,497, U.S. Pat. No. 5,609,133 and U.S. Patent Application Publication No. 2004/0112330 disclose embodiments of rocker arms with extendable pistons, including fluid lines and valves not illustrated here, and are incorporated by reference.

The positions of the pistons 71 and 45 in the cylinders 73 and 49, respectively, can be substantially binary, i.e., only movable all the way in or all the way out, or the positions can be modulated and controlled so that they can advance to any desired position between a fully extended position and a fully retracted position so that the amount that the opening of the valve 27*a* and 27*b* is advanced and/or the amount that the closing of the valve is delayed can be varied.

In addition to facilitating adjustment of the exhaust temperature, selective opening and closing of the exhaust valve 27 can facilitate engine braking. Copending International Patent Application No. PCT/US2006/061,910, filed on the same date as the present application, entitled, VALVE OPENING ARRANGEMENT AND METHOD, naming Mack Trucks, Inc., as applicant, and naming William Meacock, as inventor, discloses engine braking by opening and closing of an exhaust valve of a cylinder and is incorporated by reference. According to an aspect of the present invention, the piston 45 is moved outward so the head 47 opens a valve to achieve desired engine braking.

As seen in FIG. 9, at least one sensor 61 can be provided for sensing a condition, e.g., engine exhaust temperature, usually at a point downstream from the valve 27 such as proximate exhaust aftertreatment equipment such as a DPF (not shown), and sending a signal corresponding to the condition to a controller 59. The controller 59 can control movement of the piston 71 between an active and a retracted position in response to the signal, such as by fully or partially opening or closing a valve 75 in the hydraulic fluid line 77 and/or running the pump 57 to pump hydraulic fluid. Particularly by opening the valve 27 earlier following combustion, exhaust temperatures downstream of the valve can be increased.

The positioning of the movable piston 45 can be controlled in the same manner that the positioning of the movable piston 71 is controlled, e.g., by the controller 59 controlling operation of a pump 57 and valve 63 in a hydraulic line 53. While the piston 45 can be moved to adjust exhaust temperature, the piston 45 will ordinarily be used to achieve desired engine braking effects. Though the rocker arm 43 will ordinarily pivot during normal operation, movement of the rocker arm will ordinarily only result in engine braking when the piston 45 is extended to open a valve.

In the engine 21, the valve comprises a first and second valve 27*a* and 27*b* associated with first and second openings 29*a* and 29*b*, respectively, in the cylinder 25. The first and second valves 27*a* and 27*b* are connected to or in contact with a yoke 65 and, thus, to each other. During a normal operation mode, the first rocker arm 33 or, often, a piston head or an "elephant's foot" contact surface 67 portion of the piston 71 that extends from the cylinder 73 in a body 69 of the arm, contacts the yoke 65 to open the first and second valves simultaneously. Usually, the first rocker arm 33 or contact surface 67 contacts the yoke 65 substantially in a center of the yoke so both valves 27*a* and 27*b* open substantially simultaneously.

Where there are two valves 27*a* and 27*b*, it can be desirable to adjust the opening and closing of one of the valves relative to the ordinary opening and closing of the other one of the valves. For example, the opening and closing of the first valve 27*a* can be altered to adjust exhaust temperature and/or facilitate a degree of engine braking. Thus, the second rocker arm 43, during a modified mode of operation, can be arranged to contact the yoke 65 proximate, for example, the first valve 27*a* and can thereby cause the yoke to pivot to advance opening and/or delay closing of the first valve relative to opening and closing of the second valve by the first rocker arm which would occur according to normal pivoting of the first rocker arm 33. The second rocker arm 43 can, however, be arranged so that it contacts the yoke 65 to advance opening and/or delay closing of both valves 27*a* and 27*b* simultaneously. The ends of the valve stems 35 can be in contact with the yoke 65 but able to pivot relative to the yoke, such as by providing a convex, i.e., rounded, bearing surface at a top end of the stems for being received in a corresponding concave recess in the yoke.

In a method of modifying valve timing according to an aspect of the present invention, during a normal mode, a force is applied to a rocker arm 33 to pivot the rocker arm to urge the spring-loaded valves 27*a* and 27*b* to an open position. The force is thereafter released so the spring force moves the valve 27*a* and 27*b* to a closed position. During a modified mode, a control arrangement 41 at least partially disposed on the rocker arm 33 is operated to advance opening and/or delay closing of the valve 27*a* and 27*b* relative to opening and closing during the normal mode.

Operation of the control arrangement 41 can comprise moving a piston 71 in the rocker arm 33 from a retracted position to an active position to advance opening and/or delay closing of the valve 27. The piston 71 can be moved to a first active position and subsequently moved to a second, different active position where the first and second active positions are disposed at and/or between a fully extended position and the retracted position. By advancing opening and/or delaying closing of the valve 27, exhaust temperatures in an engine can be adjusted. In addition, an engine braking effect can be achieved.

Exhaust temperatures can be adjusted and engine braking can also be achieved by applying and releasing a force to a second rocker arm 43. For example, engine braking can comprise moving a movable piston 45 on the second rocker arm 43 from a retracted position to an active position to alter opening and/or closing of the valve 27. The piston 45 can be moved to a first active position and subsequently moved to a second, different active position where the first and second active positions are disposed at and/or between a fully extended position and the retracted position.

The valve can comprise a first and second valve 27*a* and 27*b* associated with first and second openings 29*a* and 29*b* in the cylinder 25. The first and second valves 27*a* and 27*b* can be connected by a yoke 65 and, during the normal mode, the first rocker arm 33 can contact the yoke to open the first and second valves simultaneously. During the modified mode, contact surface 67 of the piston 71 on the first rocker arm 33 can extend to an active position and can advance opening and/or delay closing of the valve 27. During another mode, which may be referred to as an engine braking mode, the second rocker min 43, usually the advanced head 47 of the piston 45 in the second rocker arm, can contact the valve 27 to alter opening and closing of the valve relative to opening and closing of the valve 27 by the first rocker arm 33 or the first rocker arm.

While the invention is applicable to a wide range of devices, it is presently contemplated that it will have particular application in connection with controlling the opening and closing of an exhaust valve in an engine to control the temperature of engine exhaust. In such an embodiment, the temperature of exhaust downstream from the valve 27 can be measured by a temperature sensor 61, which can send a signal to a controller 59 which can control movement of the piston 45 in the second rocker arm 43 in response to the measured temperature to advance or delay opening of the valve 27 to increase or decrease the temperature of the exhaust downstream from the valve.

In the present application, the use of terms such as "including" is open-ended and is intended to have the same meaning as terms such as "comprising" and not preclude the presence of other structure, material, or acts. Similarly, though the use of terms such as "can" or "may" is intended to be open-ended and to reflect that structure, material, or acts are not necessary, the failure to use such terms is not intended to reflect that structure, material, or acts are essential. To the extent that structure, material, or acts are presently considered to be essential, they are identified as such.

While this invention has been illustrated and described in accordance with a preferred embodiment, it is recognized that variations and changes may be made therein without departing from the invention as set forth in the claims.

What is claimed is:

1. An engine with a valve opening arrangement, comprising:

an engine comprising at least one cylinder and at least one valve for opening and closing an opening in the cylinder, the valve being spring loaded to a closed position;

a rocker arm including a movable contact surface for urging the valve to an open position;

a control arrangement at least partially connected to the contact surface and operable in a modified mode to at least one of advance opening and delay closing of the valve relative to opening and closing in a normal mode, the control arrangement comprising a movable piston movable to an active position to operate in the modified mode, the piston being adapted to be moved to and held at any position at and between a fully extended position and a retracted position so that the contact surface is moved relative to the rocker arm; and a second contact surface that, during an engine braking mode, forces the valve to open and close differently relative to opening and closing of the valve in the normal mode.

2. The engine with the valve opening arrangement as set forth in claim 1, wherein a head of the piston extends outwardly of a cylinder in the rocker arm when the piston is in the active position.

3. The engine with the valve opening arrangement as set forth in claim 2, wherein the piston is hydraulically driven.

4. The engine with the valve opening arrangement as set forth in claim 1, wherein the control arrangement comprises a second rocker arm that, during an engine braking mode, forces the valve to open and close differently relative to opening and closing of the second valve by the first rocker arm.

5. The engine with the valve opening arrangement as set forth in claim 1, comprising a controller and at least one sensor for sensing a condition and sending a signal corresponding to the condition to the controller, the controller being arranged to control movement of the piston to and hold the piston at any position at and between a fully extended position and a retracted position in response to the signal.

6. The engine with the valve opening arrangement as set forth in claim 1, wherein the valve comprises first and second valves at least partially disposed on first and second openings, respectively, in the cylinder, the first and second valves being connected by a yoke.

7. The engine with the valve opening arrangement as set forth in claim 6, wherein, during the normal mode, the contact surface contacts the yoke to open the first and second valves simultaneously.

8. The engine with the valve opening arrangement as set forth in claim 6, comprising a second contact surface that, during an engine braking mode, contacts the yoke proximate the first valve and causes the yoke to pivot to alter opening and closing of the first valve relative to opening and closing of the first valve in the normal mode.

9. The engine with the valve opening arrangement as set forth in claim 1, wherein the first and second contact surfaces are connected to first and second rocker arms that are pivoted by at least one cam on a common cam shaft.

10. The engine with the valve opening arrangement as set forth in claim 1, wherein the movable piston is in a retracted position when the engine is in the normal mode.

11. The engine with the valve opening arrangement as set forth in claim 10, comprising a second movable piston movable to an active position to alter opening and closing of the valve relative to opening and closing of the valve by the first movable piston.

12. The engine with the valve opening arrangement as set forth in claim 10, wherein the valve comprises first and second valves associated with first and second openings in the cylinder, the first and second valves being connected by a yoke.

13. The engine with the valve opening arrangement as set forth in claim 12, wherein, during the normal mode, the first contact surface contacts the yoke to open the first and second valves simultaneously.

14. The engine with the valve opening arrangement as set forth in claim 13, wherein, during an engine braking mode, the second contact surface contacts the yoke proximate the first valve and causes the yoke to pivot to alter opening and closing of the first valve relative to opening and closing of the first valve by the first contact surface.

15. The engine with the valve opening arrangement as set forth in claim 1, wherein the valve is an exhaust valve.

16. The engine with the valve opening arrangement as set forth in claim 15, wherein the control arrangement includes a controller and a temperature sensor arranged to send a signal to the controller corresponding to a temperature of exhaust downstream of the exhaust valve, the controller being configured to adjust opening and closing of the exhaust valve in response to the signal from the temperature sensor.

17. A method of modifying valve timing, comprising:

during a normal mode, moving a contact surface by pivoting a rocker arm to apply a force to urge a spring-loaded valve to an open position, and thereafter releasing the force so the spring force moves the valve to a closed position;

during a modified mode, operating a control arrangement at least partially connected to the contact surface to at least one of advance opening and delay closing of the valve relative to opening and closing during the normal mode, opening and closing of the valve being altered relative to opening and closing of the valve during the normal mode by moving a movable piston associated with the contact surface to and holding the piston at an active position between a fully extended and a fully retracted position so that the contact surface is moved relative to the rocker arm; and during an engine braking mode, contacting the valve with a second contact surface to force the valve to open and close differently relative to opening and closing of the valve in the normal mode.

18. The method of modifying valve timing as set forth in claim 17, wherein operation of the control arrangement comprises moving the piston to and holding the piston at a first active position and subsequently moving the piston to and holding the piston at a second, different active position, the first and second active positions being disposed at any position at and between a fully extended position and the retracted position.

19. The method of modifying valve timing as set forth in claim 17, wherein the valve comprises first and second valves associated with first and second openings, respectively, in a cylinder, the first and second valves being connected by a yoke and wherein, during the normal mode, the contact surface contacts the yoke to open the first and second valves simultaneously.

20. The method of modifying valve timing as set forth in claim 19, wherein, during the engine braking mode, the second contact surface contacts the yoke proximate the first valve and causes the yoke to pivot to alter opening and closing of the first valve relative to opening and closing of the first valve by the first contact surface.

21. The method of modifying valve timing as set forth in claim 17, wherein the first and second contact surfaces comprise parts of first and second rocker arms, the method comprising pivoting the first and second rocker arms under action of a common cam.

22. The method of modifying valve timing as set forth in claim 17, wherein the valve is an exhaust valve in an engine, the method comprising measuring a temperature of exhaust downstream from the valve and controlling operation of the control arrangement in response to the measured temperature to increase or decrease the temperature of the exhaust downstream from the valve.

23. A device with a valve opening arrangement, comprising:

at least one cylinder and at least one valve for opening and closing an opening in the cylinder, the valve being spring loaded to a closed position;

a rocker arm including a movable contact surface for urging the valve to an open position;

a control arrangement at least partially connected to the contact surface and operable in a modified mode to at least one of advance opening and delay closing of the valve relative to opening and closing in a normal mode, the control arrangement comprising a movable piston movable to an active position to operate in the modified mode, the piston being adapted to be moved to and held at any position at and between a fully extended position and a retracted position so that the contact surface is moved relative to the rocker arm; and a second contact surface that, during an engine braking mode, forces the valve to open and close differently relative to opening and closing of the valve in the normal mode.

* * * * *